United States Patent [19]

Shogren et al.

[11] 4,407,581

[45] Oct. 4, 1983

[54] COMPACT OPTICAL SCANNING SYSTEM

[75] Inventors: David K. Shogren, Ontario; Robert G. Zambelli, Rochester, both of N.Y.

[73] Assignee: Xerox Corporation, Stamford, Conn.

[21] Appl. No.: 378,691

[22] Filed: May 17, 1982

[51] Int. Cl.[3] ..... G03G 15/28

[52] U.S. Cl. ..... 355/8; 355/11; 355/66

[58] Field of Search ..... 355/8, 11, 3 R, 65, 355/66, 43, 45

[56] References Cited

U.S. PATENT DOCUMENTS

| | | | |
|---|---|---|---|
| 3,832,057 | 8/1974 | Shogren | 355/8 |
| 4,095,880 | 6/1978 | Shogren et al. | 355/8 |
| 4,113,373 | 9/1978 | Eppe et al. | 355/8 |
| 4,118,118 | 10/1978 | Barto | 355/55 X |
| 4,299,475 | 11/1981 | Nagahara | 355/8 |

*Primary Examiner*—R. L. Moses

[57] ABSTRACT

A compact scan document system is enabled by adding motion to the scanning and projection components used in a folded optical system. A general and preferred velocity relationship is set for the system optical elements and a mechanical drive arrangement is disclosed which enable the specific ratios required.

In a preferred embodiment, a pulley/belt system is used to provide four velocities such that a document is scanned at a first velocity V, the document image is reflected to a folding mirror arrangement traveling at 0.75 V and projected by a lens moving at a 0.5 V velocity to a photoreceptor image plane via another folding mirror arrangement moving at a 0.25 V ratio.

8 Claims, 7 Drawing Figures

COMPACT OPTICAL SCANNING SYSTEM

BACKGROUND AND PRIOR ART STATEMENT

This invention relates to an optical scanning system for a copying device, and, more particularly to a system utilizing four optical elements, including a scanning lens, which moves at four different speeds relative to each other.

Various optical systems known in the art achieve a certain degree of compactness by utilizing a full rate-half rate scanning mirror pair which is mounted for parallel movement beneath a document to be copied. U.S. Pat. Nos. 4,113,373 and 3,832,057 and the Xerox "3100" Copier disclose scanning systems representative of this technique. In this type of system, two components, the full-rate and the half-rate mirrors are moving at the predetermined relationships. The projection lens and, typically, a photoreceptor mirror, are held fixed during a scanning mode. For these prior art optical systems, a reduction capability is imparted by moving the projection lens towards the photoreceptor and adjusting the position of the photoreceptor mirror to maintain the required total conjugate. These movements, however, are initiated upon selection of the reduction mode and do not take place during the scanning operation. U.S. Pat. No. 4,095,880 discloses such a scanning system illustrating a scanning mode of operation in a reduction mode.

For scanning systems of the type disclosed above, total conjugates typically fall within the 28"-35" range. The Xerox "3100" copier for example, has a 29.9 inch total conjugate. It would be very desirable to reduce this conjugate length even further since a shorter conjugate length reduces the dimension of the machine housing needed to enclose the optical system which, in turn, results in reduction in overall machine size. The advantage of more compact copier designs are well appreciated in the art. They include savings in material and construction costs and greater customer acceptance because of reduced space requirements and increased portability.

The present invention is therefore directed to a novel scanning system which reduces conventional conjugate requirements by half. This reduction is achieved by adding motion to the projection lens during the scanning mode, permitting the object-to-lens and lens-to-image plane distances to be significantly reduced. In order to compensate for the lens movement, two additional moving optical components are introduced into the scanning system resulting in a multiple (four) rate document scanning system. More particularly, the invention relates to a multi-rate scanning system for scanning a document lying in an object plane and projecting an image along an optical path onto a photoreceptor plane, said system including the following optical elements: an illumination/mirror scanning assembly including a first mirror associated with the illumination means and adapted for movement in the scan direction at a velocity V1 and a second mirror adapted for movement in the scan direction at a velocity V2; a projection lens lying in a plane parallel to said illumination/mirrror assembly and adapted to move in the scan direction at a velocity V3; and a third mirror means adapted to move in the scan direction at a velocity V4; and a drive arrangement for driving said optical elements at a velocity relatively whereby $V1>V2>V3>V4$.

Various other embodiments disclosing variations of the multi-rate scan concept are provided, together with descriptions of magnification modes of operation for each particular system. Also disclosed is a preferred cable-pulley mechanical arrangement for enabling specific four-rate scanning motions.

DESCRIPTION

Figure 1:
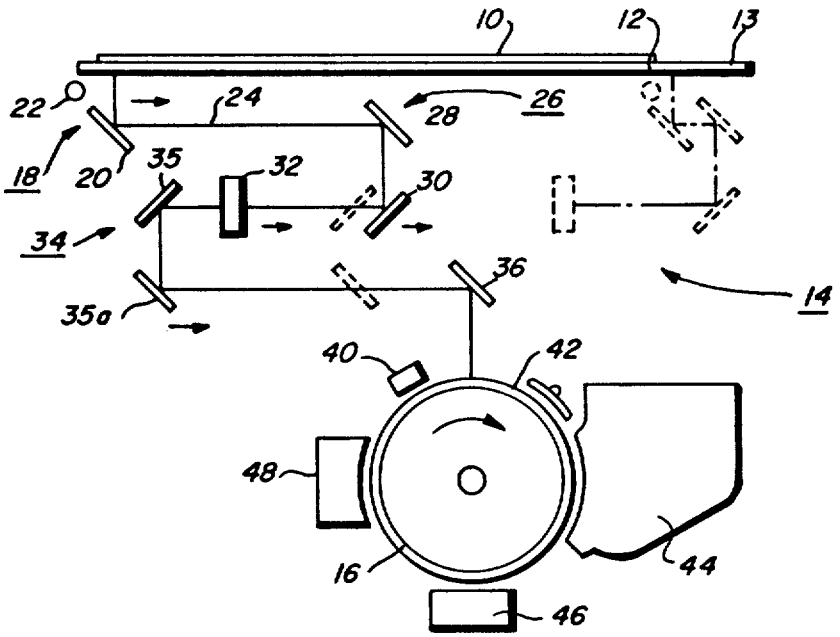
FIG. 1 is a schematic drawing of a first embodiment of a unity magnification compact scan system utilizing scan elements having four separate linear velocities.

Referring now to FIG. 1, there is shown a first embodiment of the present invention wherein a document 10, supported on a transparent platen 12, is scanned by a multi-rate scanning system 14 and is reproduced, at unity magnification, at the surface of photoreceptor drum 16. Scanning system 14 consists, essentially, of four components, all moving in the same direction (scan or rescan) and at certain speed relationships with relation to each other. Scan assembly 18 consists of scan mirror 20 and illumination lamp 22, both of which move in a horizontal path below platen 12 at a first rate V. These components, having a linear length extending into the page, cooperate to illuminate and scan longitudinally extending incremental areas of the document. Although the reflected image actually comprises a bundle of rays, for ease of description, only the principal ray is shown.

Scanned incremental images reflected from mirror 20 are directed along optical path 24 to object side corner mirror assembly 26 comprising mirros 28 and 30. Mirror assembly 26 is adapted for movement in the same direction as scan assembly 18 and in a parallel plane. In a preferred embodiment, mirror assembly 26 is traveling at a rate V2 which is $\frac{3}{4}$ of the assembly 18 rate or at 0.75V. The reflected rays from mirror assembly 26 are directed into projection lens 32 moving in the indicated direction at a rate V3, $\frac{1}{2}$ of the scan rate or at 0.5V. The projected rays are then reflected by corner mirror assembly 34, comprising mirrors 35, **35*a* onto a fixed drum mirror 36 and then onto the surface of drum 16, recording a flowing light image of the original document. Mirror assembly 34** is adapted for movement at a rate V4, $\frac{1}{4}$ of the scan rate or at 0.25V.

The various processes for producing an output copy of the exposed original are well known in the art and hence a detailed description is not provided. Briefly however, at station 40 an electrostatic charge is placed uniformly over the surface of the moving photoconductive drum surface. The charged drum surface is then moved through an exposure station 42, where the flowing light image of the document 12 is recorded on the drum surface. As a result of this imaging operation the charge on the drum surface is selectively dissipated in the light-exposed region thereby recording the original input information on the photoconductive plate surface in the form of a latent electrostatic image. Next, in the direction of drum rotation, the image bearing plate surface is transported through a development station 44 wherein a toner material is applied to the charged surface thereby rendering the latent electrostatic image visible. The now developed image is brought into contact with a sheet of final support material, such as paper or the like, within a transfer station 46 wherein the toner image is electrostatically attracted from the photoconductive plate surface to the contacting side of the support sheet. Station 48 represents a mechanism for cleaning toner from the drum surface.

Figure 2:
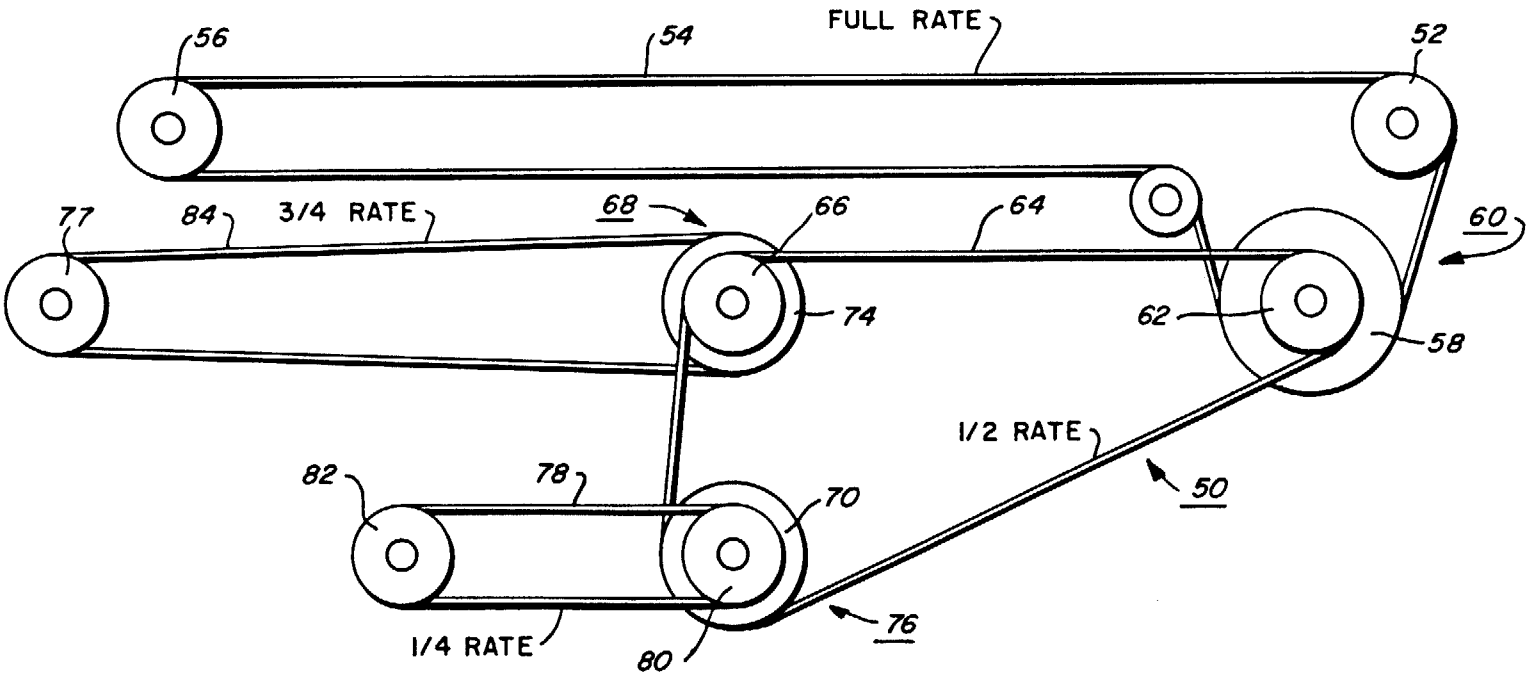
FIG. 2 is a simplified schematic of a pulley/belt system to drive the scanning elements of the FIG. 1 embodiment.

FIG. 1 was used to illustrate schematically the principles of a multi-rate scan system. FIG. 2 shows schematic details of a pulley/belt drive system for driving the four moving optical elements.

Referring to FIG. 2, there is shown a first four-rate timing pulley/timing belt drive system 50. In this system, an input timing pulley 52 having 12 teeth (12T) is driven by an input means (not shown) at an angular velocity such that a first velocity V1 is imparted to timing belt 54. Belt 54 forms an endless path between idler pulley 56 and pulley 58 of cluster pulley pair 60. Cluster pulley pair 60 comprises pulleys 58 and 62, the pulleys having a 24T to 12T ratio, respectively. Timing belt 64 is entrained about 12T pulley 62, 12T pulley 66 of cluster pulley pair 68 and 24T pulley 70 of cluster pulley pair 76. Timing belt 73 is entrained about 18T pulley 74, the second pulley of cluster pulley pair 68, and 12T idler pulley 77. Timing belt 78 is entrained about 12T pulley 80, the second pulley of cluster pulley 76, and about 12T idler pulley 82.

Application of the input to 12T pulley 52 establishes an initial velocity V to timing belt 54. This velocity is halved by the 24:12 ratio of pulley 58 to input pulley 52. Belt 64 is therefore driven at a velocity of 0.5V. This 0.5V velocity is halved again by the 24:12 ratio of pulley 74 to pulley 80 in cluster pulley pair 76. Belt 78 is therefore driven at a velocity of 0.25V. The 0.5V velocity is stepped up by the 12:18 ratio of pulley 66 to pulley 74 respectively to drive belt 84 at a 0.75V velocity.

Upon establishing of these velocity ratios, the various optical components of FIG. 1 can be attached on appropriate carriage means, to their respective drive belts. Thus scan mirror 20 and clamp 22 would be attached to full velocity belt 54. Corner mirror assembly 26 would be attached to 0.75V belt 84. Lens 32 would be attached to 0.5V belt 64 and corner mirror assembly 34 would be attached to 0.25 belt 78.

When a print mode of operation is initiated, input power is applied to pulley 52 driving it and belt 54 in a clockwise direction. Assuming an input relative velocity of 8 ips; scan assembly 18 moves from the start of scan position at the left side of the FIG. 1 system along a horizontal path of travel beneath platen 12 and at a velocity 8 ips. Illumination lamp 22 incrementally illuminates a longitudinally extending area of the document within the viewing domain of mirror 20. Mirror assembly 26, lens 32 and mirror assembly 34 move at velocities of 6 ips, 4 ips and 2 ips respectively in the same direction as scan assembly 18. During the scan cycle, the object and image conjugates are maintained equal keeping the total conjugate (15 inches) at the desired values. At the end-of-scan position (shown in dotted form in FIG. 1), the driver input to pulley 52 is reversed, the driving belt relation is reversed and the scan components return to their start-of-scan position.

Figure 3:
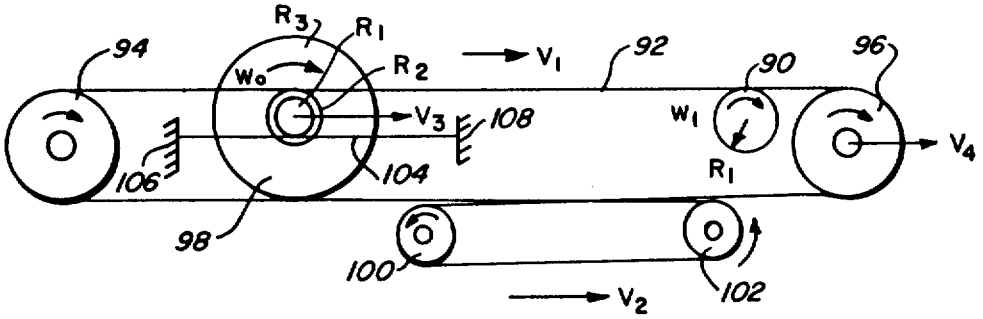
FIG. 3 is a simplified schematic of a second cable scan system to drive the scanning elements of the FIG. 1 embodiment.

The scanning system shown in FIGS. 1 and 2 employed a regular geometric ratio for the four velocities. The 1-$\frac{3}{4}$-$\frac{1}{2}$-$\frac{1}{4}$ relationship is preferred because it simplifies the belt/pulley relationships. However other velocity ratios are possible so long as $V4<V3<V2<V1$. A broad range of desired alternate velocity ratios can be established by changing the cluster pulley teeth ratio provided in the FIG. 2 arrangement. There is some limitation in a timing pulley/belt arangement if a ratio is selected such that a fractional value less than 1 tooth is required. For these cases a pulley/cable arrangement may be appropriate since the pulley diameter can be changed to establish any desired ratio. FIG. 3 shows such a system.

Referring to FIG. 3, tyhere is shown a second four-rate cable system. In this system input capstan 90 is driven by an input means (not shown) at an angular velocity $\omega_I$ to impart a first velocity V1 to cable 92. Cable 92 forms an endless path between pulleys 94, 96, component capstan 98 and reverse pulleys 100, 102. The reverse pulleys 100, 102 are rigidly mounted and serve to reverse the direction of cable 92 movement moving the lowermost portion of cable 92 available at the second velocity V2. Component capstan 98 has three associated radii $R_1$, $R_2$ and $R_3$ as shown. The capstan is driven at an angular velocity of $\omega_c$ by cable 92. Cable 104 is wrapped around radius $R_1$ segment and connected between fixed points 106 and 108. As capstan 98 is rotated, cable 104 provides movement at a third velocity V3. Finally, pulleys 94 and 96 are rigidly connected as a pair and provide a fourth velocity V4.

The velocities V1, through V4 are governed by the following equations.

$$V1=\omega_I R_I \quad (1)$$

$$V3=V1R_1/(R_1+R_2) \quad (2)$$

$$V2=\omega_C R_3-V3 \text{ or} \quad (3)$$

$$V2=(V3R_3/R_1)-V3 \quad (4)$$

$$V4=V1-V2 \quad (5)$$

Solving these equations for the full-rate, $\frac{3}{4}$, $\frac{1}{2}$ and $\frac{1}{4}$ rate system described above in the description of the FIG. 1 embodiment; $V1=100$; $V2=75$; $V3=50$ and $V4=25$. If $R_1$ is set equal to a unit 1 value by equation (2), $R_2=1$ and by equation (4), $R_3=2.5$. With this relationship between the radii established, the other values required for the particular scanning system can readily be established.

The FIG. 1 embodiment described above provides a 1X reproduction of a document size up to 17"×11". The scanning system can also be adapted to operate in a reduction mode of operation by changing the object and image conjugates and the scanning to drum speed in relationships known to those skilled in the art. The conjugate can be changed by shifting the position of mirror assembly 26 or 28 and lens 32. Two of these components must change their relative positions.

For certain systems it may be desirable to limit the scanning length to 11 inches or less. In order to copy a 17 inch document, the above systems can be modified to impart a velocity V5 to the platen in a direction opposite the optics scan direction. The sum of the two velocities, optics scan V1 and platen scan V5 would equal the greatest copy length L to be scanned. Also, the velocities of the platen and optics movement would be adjusted such that the absolute sum of velocities times the optical magnification would equal the process velocity.

Figure 4:
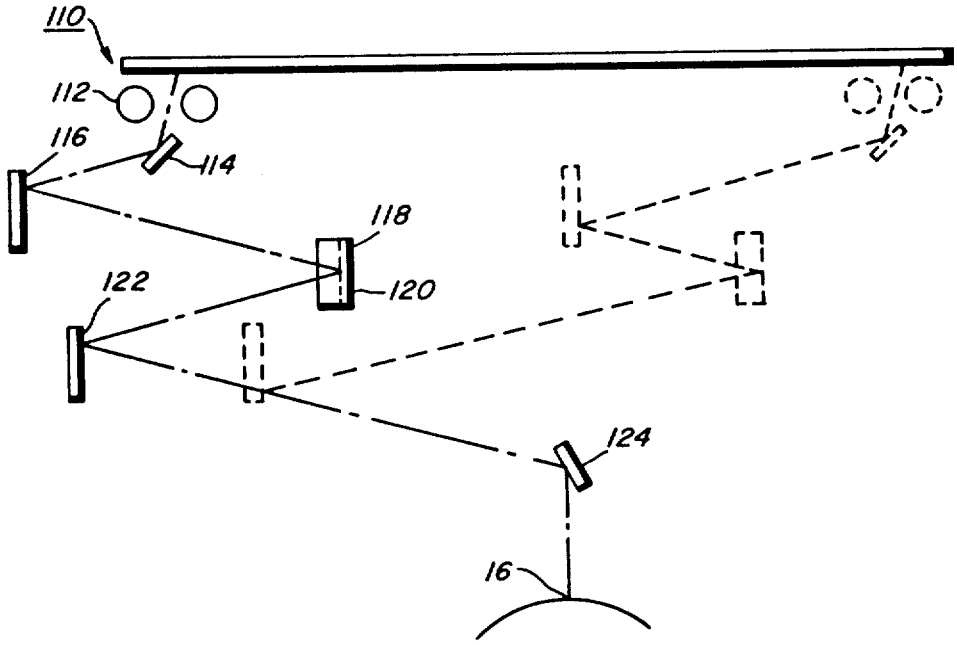
FIG. 4 is a schematic drawing of a second embodiment of a compact scan system utilizing a half-lens as the projecting element.

FIG. 4 illustrates a second embodiment of a multi-rate scanning system utilizing a half-lens as the projection element. In this configuration, scan assembly 110, comprising illumination lamp 112 and scan mirror 114 are moving at velocity V. A second, folding mirror 116 is moving at 0.75V. Half lens 118, into which is incorporated an erect 90° roof mirror 120 is moving at 0.5V. Mirror 122 is moving at the 0.25V rate. The scan operation is as described above for the FIG. 1 embodiment with the scanned image being projected onto drum 16 via mirror 124. The advantage of this embodiment is that the distances of mirrors 114, 116 and 122 from the object and image planes respectively is considerably reduced, reducing the mirror flatness requirements. Also, some cost savings may be achieved, using a half-lens.

A variation of the FIG. 4 embodiment can be obtained by removing the roof mirror from the lens assembly and using a roof mirror in place of the folding mirror 116.

Figure 5:
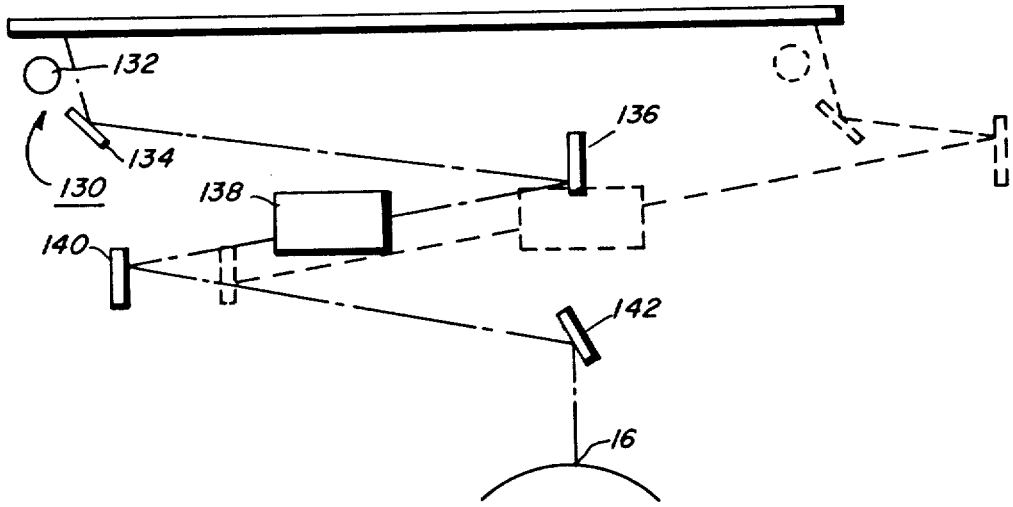
FIG. 5 is a schematic drawing of a third embodiment of a compact scan system utilizing a transmission type lens.

FIG. 5 shows a third embodiment of a multi-rate scan system employing fewer mirrors than the other embodiments but trading off against the requirement of using a transmission lens. Referring to FIG. 5, scan assembly 130 comprising lamp 132 and scan mirror 134, moves at the full scan rate V. Mirror 136 moves at the 0.75V rate; lens 138 at the $\frac{1}{2}$ rate and mirror 140 at the $\frac{1}{4}$ rate. Mirror 142 is fixed. This system has the advantage of reduced mirror flatness requirements and also a lower angle of incidence.

Other changes are possible consistent with the principles of the invention. For example, while the drum mirror has been shown to be stationary in all three embodiments, some movement can be imparted to the mirror in order to move the image being laid down on the drum surface in a direction opposite to the drum rotation. The principles of this precession type movement, and its attendant benefits, are disclosed in U.S. application Ser. No. 190,110 filed on Sept. 24, 1980 and assigned to the same assignee as the present inventioin. The photoreceptor surface can be a belt type configuration rather than the drum type shown. Other drive means are also possible. For example, a rack and pinion arrangement can be provided wherein concentric gears are provided with a desired set of diameter ratios, each gear driving a rack upon which the appropriate optical component is mounted. Other modifications are also possible consistent with the principles of the present invention.

What is claimed is:

1. A multi-rate scanning system for scanning a document lying in an object plane and projecting an image along an optical path onto a photoreceptor plane, said system including the following optical elements:

an illumination/mirror scanning assembly including a first reflective means associated with the illumination means and adapted for movement in the scan direction at a velocity V1 and a second reflective means adapted for movement in the scan direction at a velocity V2;

a projection lens lying in a plane parallel to said illumination/mirror assembly and adapted to move in the scan direction at a velocity V3;

a third reflective means adapted to move in the scan direction at a velocity V4; and a drive arrangement for driving said optical elements at a velocity relatively whereby $V1>V2>V3>V4$.

2. The scanning system of claim 1 wherein the drive arangement provides a speed ratio of $V4=0.25V1$; $V3=0.5V1$ and $V2=0.75V1$.

3. The scanning system of claims 1 or 2 wherein said drive arrangement comprises a plurality of timing belts driven by associated timing pulleys at velocities determined by the teeth ratios of the respective pulleys.

4. The scanning system of claims 1 or 2 wherein said drive arrangement comprises a pulley/cable arrangement wherein various portions of a cable system are driven at velocities determined by the respective diameters of the drive pulleys.

5. The scanning system of claim 3 wherein said first reflective and illumination means is mounted on a first timing belt driven at a first velocity V1, said sensed reflective means is mounted upon a second timing belt driven at a second velocity V2, said projection lens is mounted upon a third timing belt driven at a velocity V3 and said third reflective means is mounted on a fourth timing belt driven at a velocity V4.

6. The scanning system of claim 1 wherein said second and third reflective means are corner mirror assemblies, said system further including a fourth reflective means between said third reflective means and said photoreceptor.

7. The scanning system of claim 1 wherein said second and third reflector means are folding mirrors, and said projection lens is a half-lens incorporating a 90° roof mirror interior to said lens.

8. The scanning system of claim 1 further including a movable document platen lying in the object plane, said platen movable, during scan, in a direction opposite said scanning assembly at a velocity V5 whereby the absolute sum of V1 and V5 equals the document length L.

* * * * *